US010727627B2

(12) United States Patent
Motoshige

(10) Patent No.: US 10,727,627 B2
(45) Date of Patent: Jul. 28, 2020

(54) POWER SUPPLY CIRCUIT BREAKING DEVICE

(71) Applicant: YAZAKI CORPORATION, Tokyo (JP)

(72) Inventor: Yuichi Motoshige, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/437,089

(22) Filed: Jun. 11, 2019

(65) Prior Publication Data

US 2019/0379162 A1 Dec. 12, 2019

(30) Foreign Application Priority Data

Jun. 12, 2018 (JP) ..... 2018-112041

(51) Int. Cl.

| | |
|---|---|
| ***H01R 13/629*** | (2006.01) |
| ***H01H 9/08*** | (2006.01) |
| ***H01H 9/10*** | (2006.01) |
| ***H01R 13/436*** | (2006.01) |
| ***H01R 13/639*** | (2006.01) |

(Continued)

(52) U.S. Cl.

CPC ..... *H01R 13/62955* (2013.01); *H01H 9/085* (2013.01); *H01H 9/104* (2013.01); *H01R 13/4362* (2013.01); *H01R 13/62905* (2013.01); *H01R 13/639* (2013.01); *H01R 13/6295* (2013.01); *H01R 13/62938* (2013.01); *H01R 13/641* (2013.01); *H01R 13/701* (2013.01)

(58) Field of Classification Search

CPC ..... H01R 13/6295; H01R 13/62955; H01R 13/62938; H01R 13/641; H01R 13/701

See application file for complete search history.

(56) References Cited

U.S. PATENT DOCUMENTS 5,443,393 A * 8/1995 Okumura ..... H01R 13/62938 439/157
6,419,507 B2 * 7/2002 Kurimoto ..... H01R 13/62938 439/157

(Continued)

FOREIGN PATENT DOCUMENTS

JP 2005-142107 A 6/2005
JP 2012-119292 A 6/2012

(Continued)

*Primary Examiner* — Tho D Ta
(74) *Attorney, Agent, or Firm* — Sughrue Mion, PLLC

(57) ABSTRACT

A power supply circuit breaking device includes a first connector housing, a second connector housing, a main lock unit locking in a finally fitted state in which the second connector housing is completely fitted to the first connector housing, a sub-lock unit locking in a temporarily fitted state in which a part of the second connector housing is fitted to the first connector housing, a main switch unit switched on in the finally fitted state and the temporarily fitted state, and a sub-switch unit switched on in the finally fitted state and switched off in the temporarily fitted state. The sub-lock unit includes a sub-lock claw formed in the first connecter housing, and an operation portion provided in the second connector housing and having an engaging plate portion engaged with the sub-lock claw in the temporarily fitted state.

5 Claims, 11 Drawing Sheets

(51) Int. Cl.
*H01R 13/641* (2006.01)
*H01R 13/70* (2006.01)

(56) References Cited

U.S. PATENT DOCUMENTS

| | | | | |
|---|---|---|---|---|
| 8,986,024 | B2 * | 3/2015 | Ikeda | H01H 9/102 439/157 |
| 9,171,685 | B2 * | 10/2015 | Henmi | H01H 35/003 |
| 2005/0098419 | A1 | 5/2005 | Matsui et al. | |
| 2013/0237078 | A1 | 9/2013 | Ikeda et al. | |

FOREIGN PATENT DOCUMENTS

| | | | |
|---|---|---|---|
| JP | 2012-243559 | A | 12/2012 |
| JP | 2015-95403 | A | 5/2015 |
| WO | 2015016771 | A1 | 2/2015 |

* cited by examiner

POWER SUPPLY CIRCUIT BREAKING DEVICE

CROSS-REFERENCE TO RELATED APPLICATIONS

This application is based on and claims priority under 35 USC 119 from Japanese Patent Application No. 2018-112041 filed on Jun. 12, 2018, the contents of which are incorporated herein by reference.

TECHNICAL FIELD

The present invention relates to a power supply circuit breaking device.

BACKGROUND ART

For example, a vehicle such as an electric vehicle or a hybrid vehicle is provided with a power supply circuit breaking device called a service plug configured to disconnect electrification between a power supply unit and a load for the purpose of ensuring operation safety in maintenance of an electrical system thereof. In such a power supply circuit breaking device, there is a unit configured to provide a time lag between on and off of a power supply circuit switch and a signal circuit switch and prevent the occurrence of sparks, arcs or the like resulting from an amount of remaining electricity after the signal circuit switch is switched off (see Patent Documents 1 and 2).

Patent Document 1: JP-A-2012-243559

Patent Document 2: JP-A-2005-142107

SUMMARY OF INVENTION

In the power supply circuit breaking device described above, a lock portion and a lock release operation portion are provided on a lever configured to attach and detach housings in order to ensure the time lag between on and off of a main circuit switch and the signal circuit switch. For this reason, the lever becomes long in the power supply circuit breaking device, resulting in an increase in the size of the entire device.

The present invention is made in view of the above circumstances, and an object thereof is to provide a power supply circuit breaking device which is capable of preventing generation of sparks and arcs at the time of operation and can be downsized.

In order to achieve the above-described object, a power supply circuit breaking device according to the present invention is characterized in terms of the following (1) to (5).

(1) A power supply circuit breaking device including:

a first connector housing;

a second connector housing configured to be fitted to and separated from the first connector housing;

a main lock unit configured to lock in a finally fitted state in which the second connector housing is completely fitted to the first connector housing;

a sub-lock unit configured to lock in a temporarily fitted state in which the second connector housing is displaced toward a separating direction from the finally fitted state and a part thereof is fitted to the first connector housing;

a main switch unit configured to be switched on in the finally fitted state and the temporarily fitted state; and a sub-switch unit configured to be switched on in the finally fitted state and switched off in the temporarily fitted state, wherein the sub-lock unit includes:

a claw portion formed in the first connector housing; and an operation portion provided in the second connector housing and having an engaging plate portion engaging with the claw portion in the temporarily fitted state.

(2) The power supply circuit breaking device according to (1), wherein the engaging plate portion is provided swingably with respect to the second connector housing, in the finally fitted state, the first connector housing is disposed on a back side of the engaging plate portion so as to restrict a swinging of the engaging plate portion, in the temporarily fitted state, a space is formed on the back side of the engaging plate portion so as to swing the engaging plate portion, and an engagement state in which the engaging plate portion is engaged with the claw portion is released by swinging the engaging plate portion in the temporarily fitted state.

(3) The power supply circuit breaking device according to (2), wherein the second connector housing includes a swing range restricting unit configured to restrict a swing range of the engaging plate portion of the sub-lock unit.

(4) The power supply circuit breaking device according to any one of (1) to (3), wherein the second connector housing includes a lever rotatably supported, and wherein fitting force and separation force are applied to the first connector housing by rotation of the lever.

(5) The power supply circuit breaking device according to (4), wherein the lever supported by the second connector housing is rotated at one end of the second connector housing, and wherein the sub-lock unit is provided at the other end of the second connector housing.

According to the power supply circuit breaking device configured as (1), when the lock by the main lock unit is released and the second connector housing is displaced toward a separating direction from the first connector housing, the second connector housing is locked to the first connector housing by the sub-lock unit in the temporarily fitted state. As described above, when the finally fitted state is switched to the temporarily fitted state, the sub-switch unit is switched off, while the main switch unit is maintained on. Therefore, after the sub-switch unit is switched off, the main switch unit cannot be switched off unless the lock by the sub-lock unit is released and the second connector housing is separated from the first connector housing. For this reason, the occurrence of arcs, sparks or the like resulting from remaining current generated by the main switch unit being switched off immediately after the sub-switch unit being switched off is prevented.

In addition, the sub-lock unit configured to lock the second connector housing in the temporarily fitted state includes the claw portion formed on the first connector housing, and the operation portion provided on the second connector housing and having the engaging plate portion engaging with the claw portion in the temporarily fitted state. Therefore, an increase in size can be prevented by providing the function of the sub-lock unit in the lever configured to apply fitting force and separation force to the first connector housing and the second connector housing.

That is, the occurrence of sparks, arcs or the like at the time of operation can be prevented, and miniaturization can be achieved.

According to the power supply circuit breaking device configured as (2), the engaging plate portion of the sub-lock unit whose lock with the claw portion can be released by being swung is restricted from swinging by the first connector housing disposed on the back side in the finally fitted state, and the space is formed on the back side in the temporarily fitted state so that swing can be performed. That is, the lock release by operating the operation portion of the sub-lock unit can be enabled in the temporarily fitted state, and can be prohibited in the finally fitted state. Accordingly, it is possible to prevent the lock release operation which is an erroneous operation in the sub-lock unit.

According to the power supply circuit breaking device configured as (3), when the engaging plate portion is swung to release the lock by the sub-lock unit in the temporarily fitted state, the swing range of the engaging plate portion is restricted by the swing range restricting unit, so that damage to the operation portion due to the engaging plate portion being swung more than necessary can be prevented.

According to the power supply circuit breaking device configured as (4), by rotating the lever, the fitting and separating of the second connector housing with respect to the first connector housing can be easily performed with small operation force. Further, the sub-lock unit configured to lock the second connector housing to the first connector housing in the temporarily fitted state is provided in the first connector housing and the second connector housing, so that compared with a case where the sub-lock unit is provided on the lever, the increase in the size of the device due to an increase in the size of the lever can be prevented.

According to the power supply circuit breaking device configured as (5), the sub-lock unit is provided on a side opposite to a rotation side of the lever, so that the operation of the sub-lock unit is not disturbed by the lever. Accordingly, after the second connector housing is temporarily fitted to the first connector housing by the operation of the lever, the sub-lock unit can be operated smoothly so as to release the second connector housing.

According to the present invention, it is possible to provide a power supply circuit breaking device which is capable of preventing generation of sparks and arcs at the time of operation and can be downsized.

The present invention has been briefly described as above. Details of the present invention is further clarified by reading a mode (hereinafter, referred to as "embodiment") for carrying out the invention described below with reference to attached drawings.

DESCRIPTION OF EMBODIMENTS

Hereinafter, an embodiment according to the present invention will be described with reference to the drawings.

Figure 1:
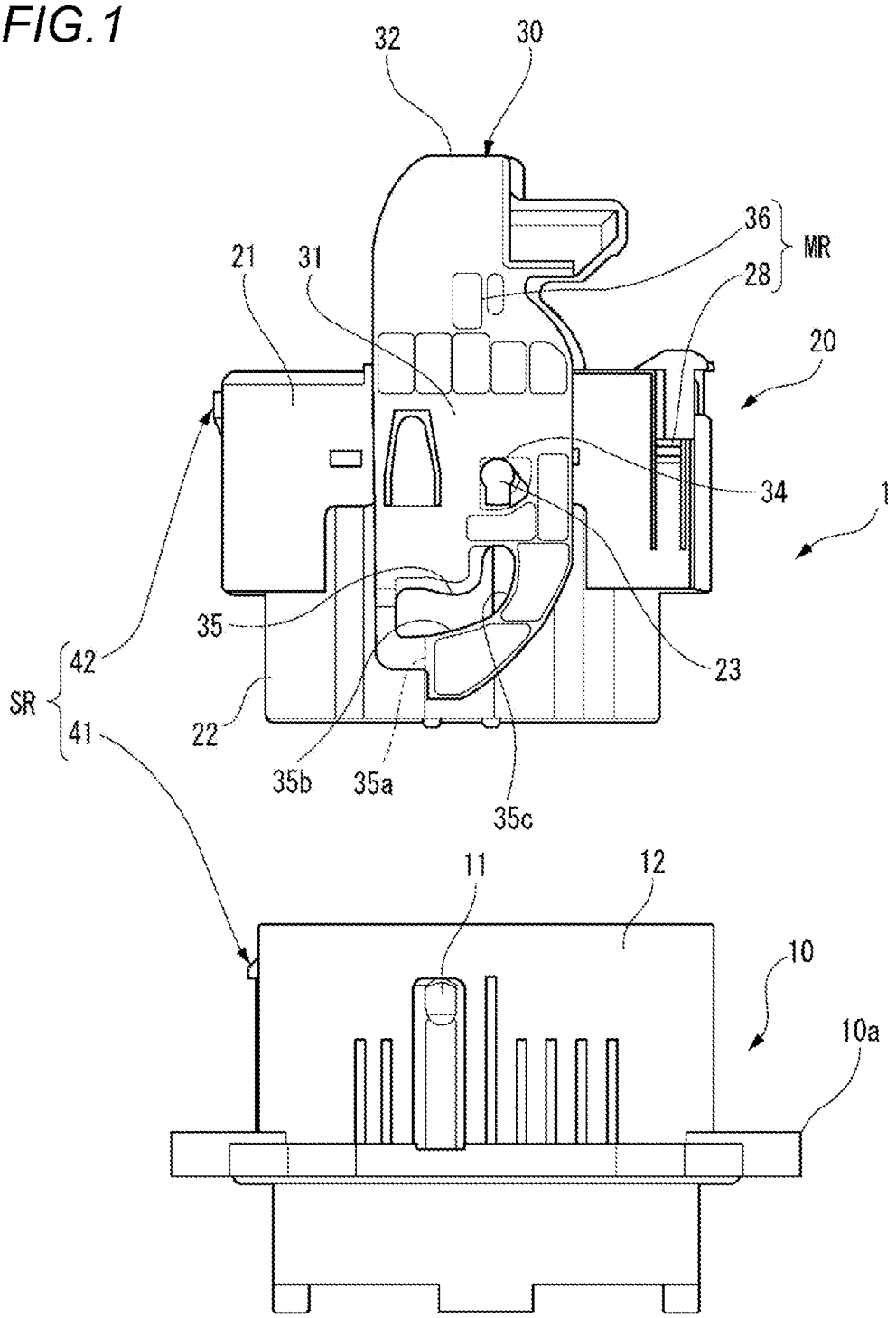
FIG. 1 is a side view of a first connector housing and a second connector housing in a power supply circuit breaking device according to an embodiment of the present invention.
Figure 2:
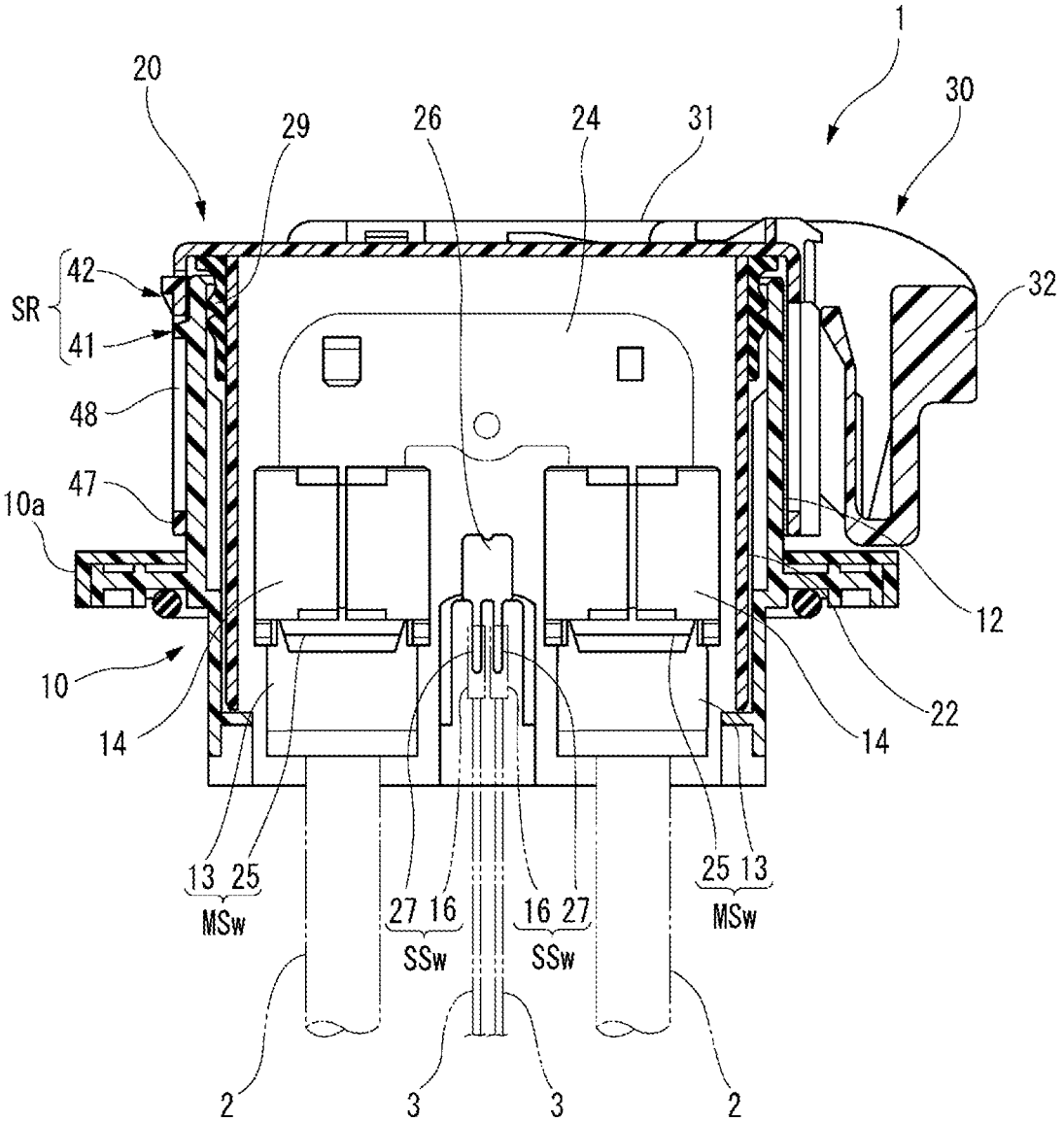
FIG. 2 is a cross-sectional view taken along an upper-lower direction of the power supply circuit breaking device.
Figure 3:
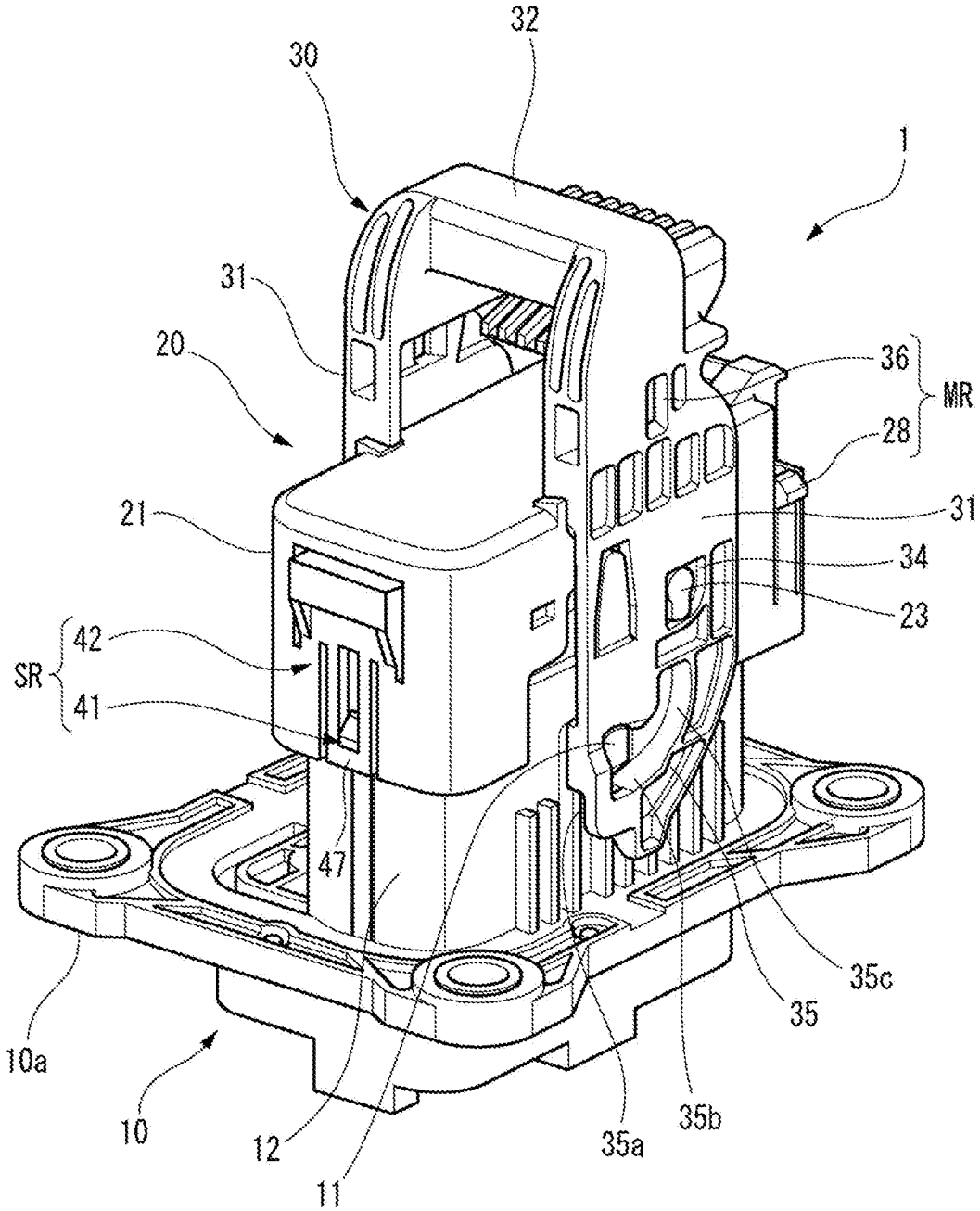
FIG. 3 is a perspective view of the power supply circuit breaking device in which the first connector housing and the second connector housing are in a temporarily fitted state.
Figure 4:
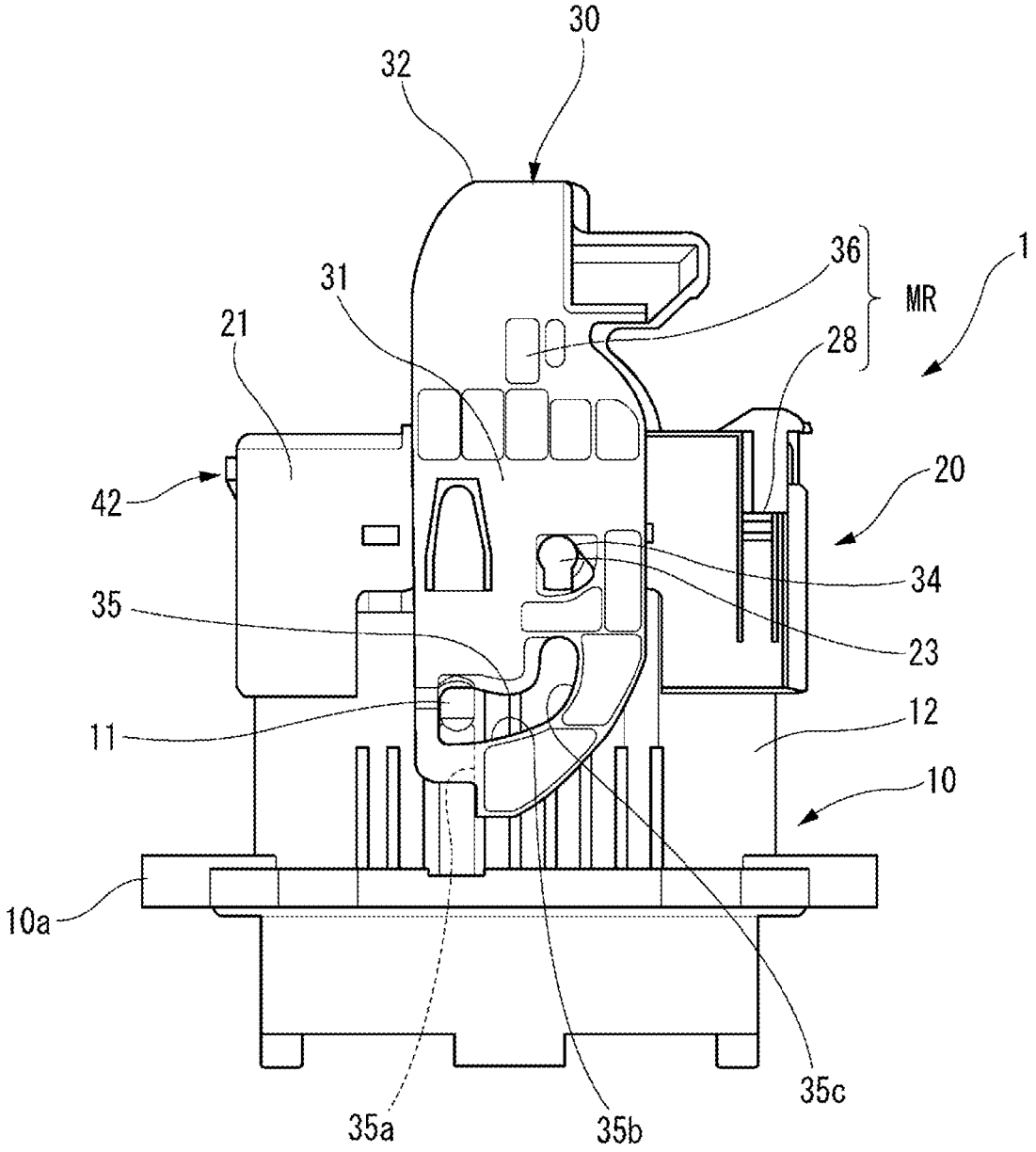
FIG. 4 is a side view of the power supply circuit breaking device in which the first connector housing and the second connector housing are in the temporarily fitted state.
Figure 5:
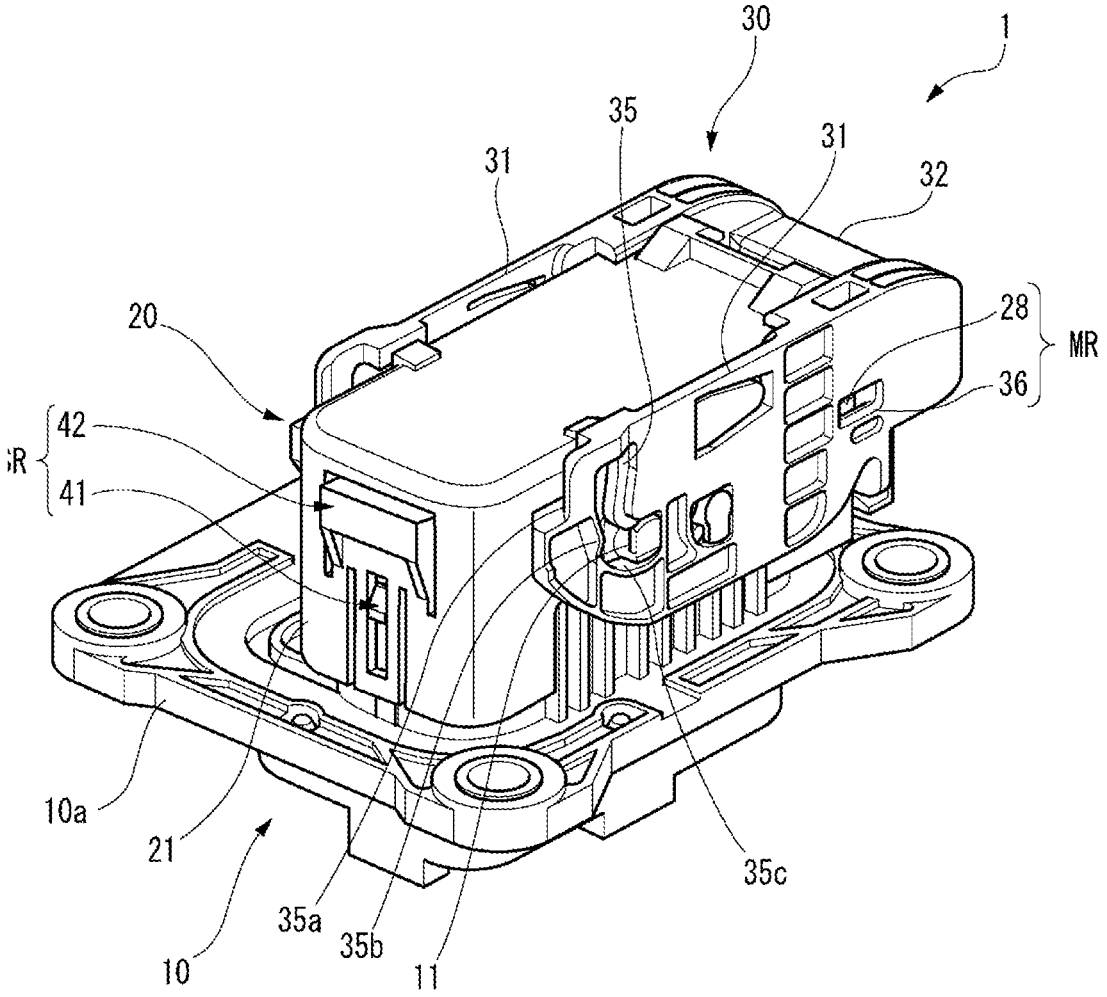
FIG. 5 is a perspective view of the power supply circuit breaking device in which the first connector housing and the second connector housing are in a finally fitted state.
Figure 6:
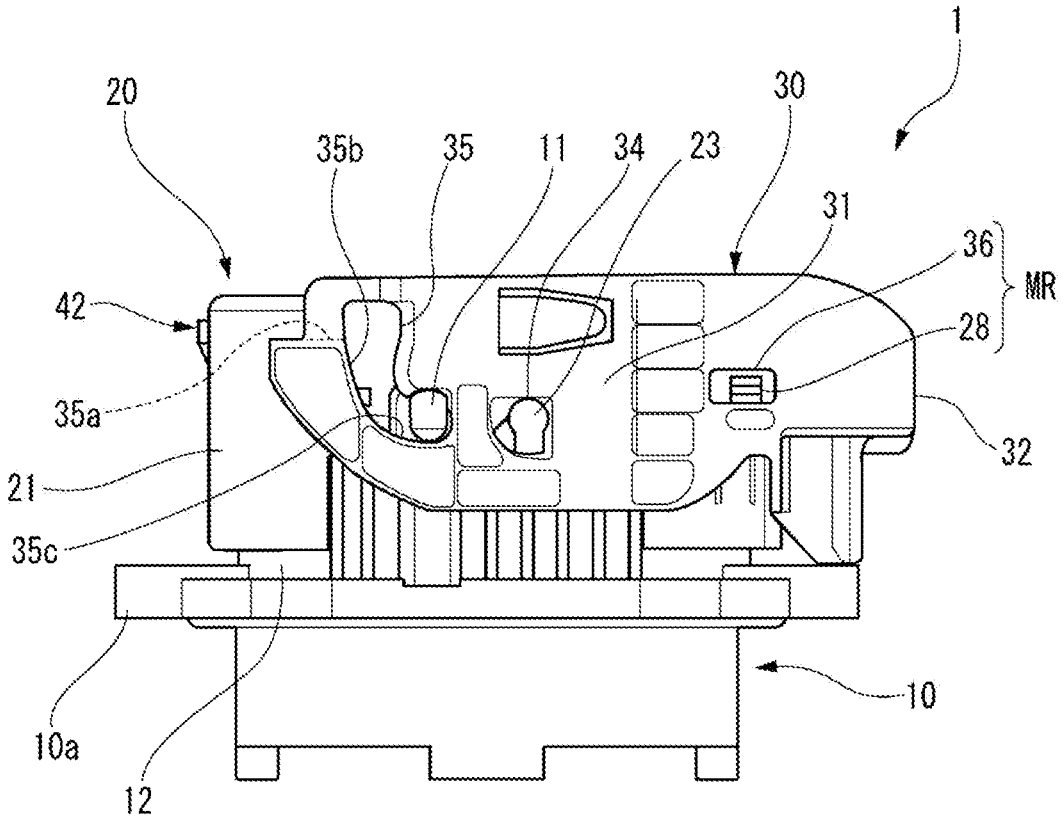
FIG. 6 is a side view of the power supply circuit breaking device in which the first connector housing and the second connector housing are in the finally fitted state.

FIG. 1 is a side view of a first connector housing and a second connector housing of a power supply circuit breaking device according to the present embodiment. FIG. 2 is a cross-sectional view taken along an upper-lower direction of the power supply circuit breaking device. FIG. 3 is a perspective view of the power supply circuit breaking device in which the first connector housing and the second connector housing are in a temporarily fitted state. FIG. 4 is a side view of the power supply circuit breaking device in which the first connector housing and the second connector housing are in the temporarily fitted state. FIG. 5 is a perspective view of the power supply circuit breaking device in which the first connector housing and the second connector housing are in a finally fitted state. FIG. 6 is a side view of the power supply circuit breaking device in which the first connector housing and the second connector housing are in the finally fitted state.

As shown in FIGS. 1 to 6, a power supply circuit breaking device 1 according to an embodiment of the present invention includes a first connector housing 10 and a second connector housing 20. The second connector housing 20 is configured to be fitted to and separated from the first connector housing 10. The second connector housing 20 includes a lever 30. The lever 30 is rotatably provided on the second connector housing 20, and applies, by rotation of the lever 30, fitting force and separation force between the second connector housing 20 and the first connector housing 10.

The power supply circuit breaking device 1 is, for example, a so-called service plug configured to disconnect electrification between a power supply unit and a load for the purpose of ensuring operation safety in maintenance of an electrical system in a vehicle such as an electric vehicle or a hybrid vehicle. Specifically, electrification between the power supply unit and the load is enabled when the second connector housing 20 is fitted to the first connector housing 10, and the electrification between the power supply unit and the load is disconnected when the second connector housing 20 is separated from the first connector housing 10.

The first connector housing 10 is formed of an insulating synthetic resin. The first connector housing 10 has a flange portion 10*a* protruding to an outer periphery, and is mounted on a power supply device or the like by fixing the flange portion 10*a* to a case. The first connector housing 10 is provided with a pair of cam pins 11 protruding from both side surfaces thereof. The first connector housing 10 includes an accommodation tubular portion 12 having an open upper surface. The accommodation tubular portion 12 is formed into a rectangular shape in a plan view. A pair of main terminals 13 formed of bus bars made of a conductive metal material is provided in the accommodation tubular portion 12 of the first connector housing 10. One end portion of the main terminal 13 is provided with female terminal portions 14. The other end portion of the main terminal 13 is connected to a power supply line 2 from a power supply device or the like. Further, a pair of sub terminals 16 formed of female terminals is provided in the accommodation tubular portion 12 of the first connector housing 10. The sub terminals 16 are connected to signal lines 3.

The second connector housing 20 is formed of an insulating synthetic resin, and includes an outer peripheral tubular portion 21 and a fitting tubular portion 22. The outer peripheral tubular portion 21 is provided with a pair of support shafts 23 protruding from both side surfaces thereof. Further, a pair of main lock claws 28 is formed near one end on both side surfaces of the outer peripheral tubular portion 21. The fitting tubular portion 22 is formed into a tubular shape whose lower side is opened, and is formed in a rectangular shape in the plan view which is slightly smaller than an outer shape of the accommodation tubular portion 12 of the first connector housing 10. A packing 29 is provided at a base portion of an outer peripheral side of the fitting tubular portion 22. The second connector housing 20 is fitted in from an upper side of the accommodation tubular portion 12 such that the fitting tubular portion 22 is fitted to the accommodation tubular portion 12 of the first connector housing 10. Then, the accommodation tubular portion 12 enters between the fitting tubular portion 22 and the outer peripheral tubular portion 21 by fitting the fitting tubular portion 22 into the accommodation tubular portion 12. Further, after the fitting tubular portion 22 is fitted to the accommodation tubular portion 12, an inner peripheral surface of an upper end of the accommodation tubular portion 12 is in close contact with the packing 29, and a space between the accommodation tubular portion 12 and the fitting tubular portion 22 is waterproof.

A main bus bar 24 formed of a conductive metal material is provided in the second connector housing 20. The main bus bar 24 includes a pair of male terminal portions 25 at both end portions thereof. The male terminal portions 25 can be connected to the female terminal portions 14 of the main terminals 13 of the first connector housing 10. Once the male terminal portions 25 of the main bus bar 24 are connected to the female terminal portions 14 of the main terminals 13, the power supply lines 2 connected to the main terminals 13 are electrically connected to each other via the main bus bar 24. A sub-bus bar 26 formed of a conductive metal material is provided inside the fitting tubular portion 22 of the second connector housing 20. The sub-bus bar 26 includes a pair of male terminal portions 27. The male terminal portions 27 of the sub-bus bar 26 can be connected to the sub terminals 16 of the first connector housing 10. Once the male terminal portions 27 of the sub-bus bar 26 are connected to the sub terminals 16, the signal lines 3 connected to the sub terminals 16 are electrically connected to each other via the sub-bus bar 26.

As described above, the power supply circuit breaking device 1 includes a main switch unit MSw configured by the main terminal 13 and the male terminal portion 25 of the main bus bar 24, and a sub-switch unit SSw configured by the sub terminal 16 and the male terminal portion 27 of the sub-bus bar 26. In a power supply device including the power supply circuit breaking device 1, a power supply circuit is formed when the main switch unit MSw is switched on and the power supply lines 2 are electrically connected to each other, and a signal circuit is formed when the sub-switch unit SSw is switched on and the signal lines 3 are electrically connected to each other. In the power supply device including the power supply circuit breaking device 1, even if the main switch unit MSw is switched on and the power supply circuit is formed, the power supply circuit is not brought into a connected state unless the sub-switch unit SSw is switched on and the signal circuit is formed. That is, only when both the main switch unit MSw and the sub-switch unit SSw are switched on, the power supply circuit is brought into the connected state.

The lever 30 is formed of a synthetic resin and includes a pair of arm portions 31 and a connection portion 32. One ends of the arm portions 31 are connected by the connection portion 32, and each of the arm portions 31 includes a shaft receiving hole 34 on the other end. The pair of support shafts 23 of the second connector housing 20 is inserted into the shaft receiving holes 34 of the arm portions 31, so that the lever 30 is rotatably supported relative to the second connector housing 20.

Cam grooves 35 are formed on the pair of arm portions 31 of the lever 30 respectively. The cam pins 11 of the first connector housing 10 are inserted into the cam grooves 35. The cam groove 35 includes an insertion portion 35*a* into or from which the cam pin 11 can be inserted or removed, a curved portion 35*b* communicating with the insertion portion 35*a*, and a bent portion 35*c* communicating with the curved portion 35*b*. The curved portion 35*b* is formed with a curve that gradually approaches a center of the shaft receiving hole 34 from the insertion portion 35*a*. The bent portion 35*c* is bent from the curved portion 35*b* toward the center of the shaft receiving hole 34.

The lever 30 is rotated between a first operation position (position shown in FIG. 4) and a second operation position (position shown in FIG. 6) when the cam pin 11 moves in the cam groove 35. The cam pin 11 is inserted into the insertion portion 35*a* at the first operation position. The cam pin 11 is disposed at the deepest position of the bent portion 35*c* at the second operation position.

Further, between the first connector housing 10 and the second connector housing 20, fitting force toward a fitting direction is applied when the lever 30 is rotated from the first operation position to the second operation position, and separation force toward a separating direction is applied when the lever 30 is rotated from the second operation position to the first operation position.

On the arm portions 31 of the lever 30, main lock holes 36 are formed in vicinity of the connection portion 32. The main lock claws 28, which are formed on the outer peripheral tubular portion 21 of the second connector housing 20, are engaged with the main lock holes 36. Further, a main lock unit MR is configured by the main lock claw 28 and the main lock hole 36. In the main lock unit MR, the main lock claw 28 is engaged with the main lock hole 36 in a state where the lever 30 is disposed at the second operation position, so that the lever 30 is locked to the second connector housing 20, and the lever 30 is restricted from rotating. Accordingly, the second connector housing 20 is locked with respect to the first connector housing 10 in a completely fitted state. Further, in the power supply circuit breaking device 1, a state where the first connector housing 10 and the second connector housing 20 are completely fitted and locked by the main lock unit MR is referred to as a finally fitted state.

Figure 7:
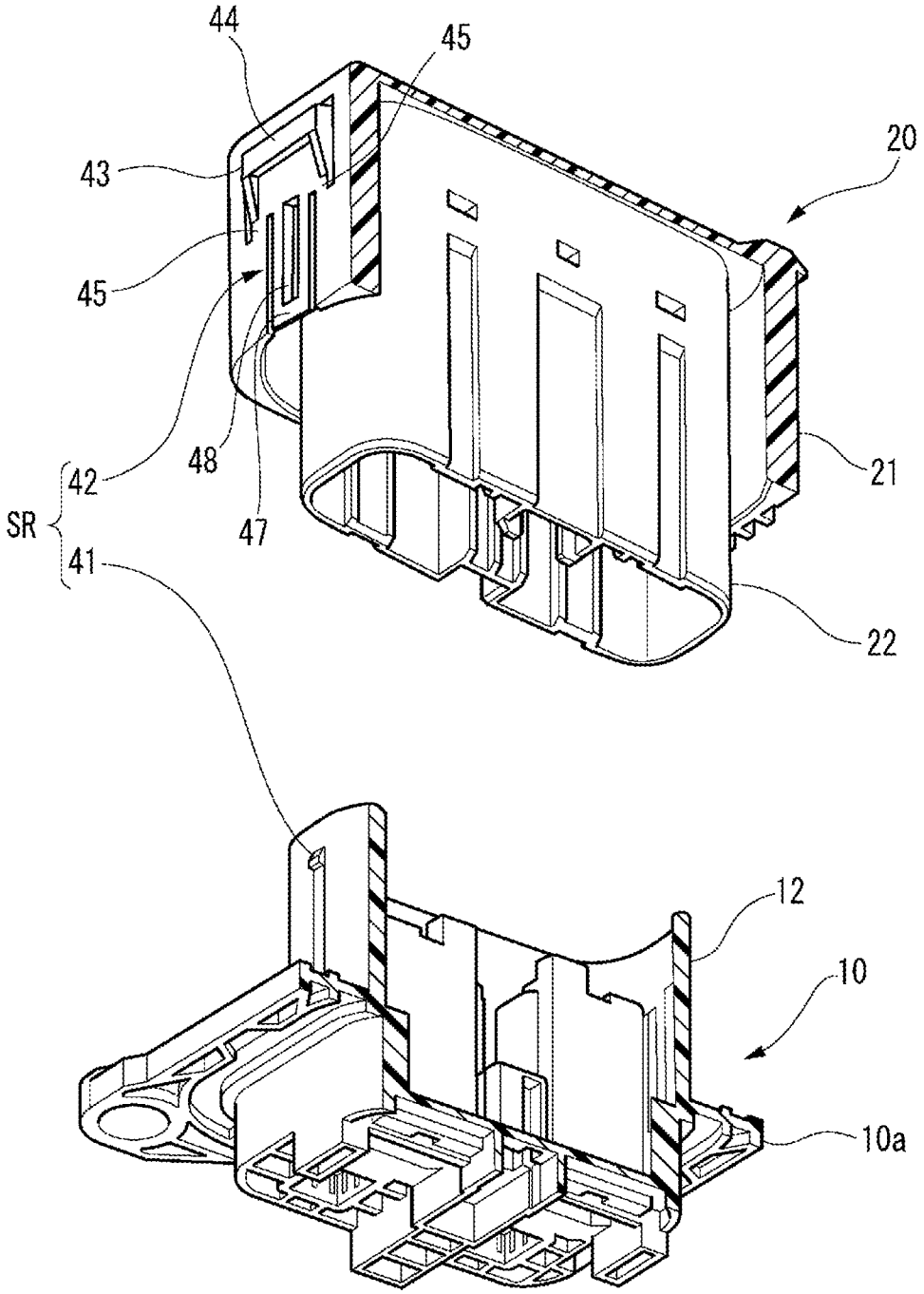
FIG. 7 is a perspective view of a part of the first connector housing and the second connector housing in cross section.
Figure 8:
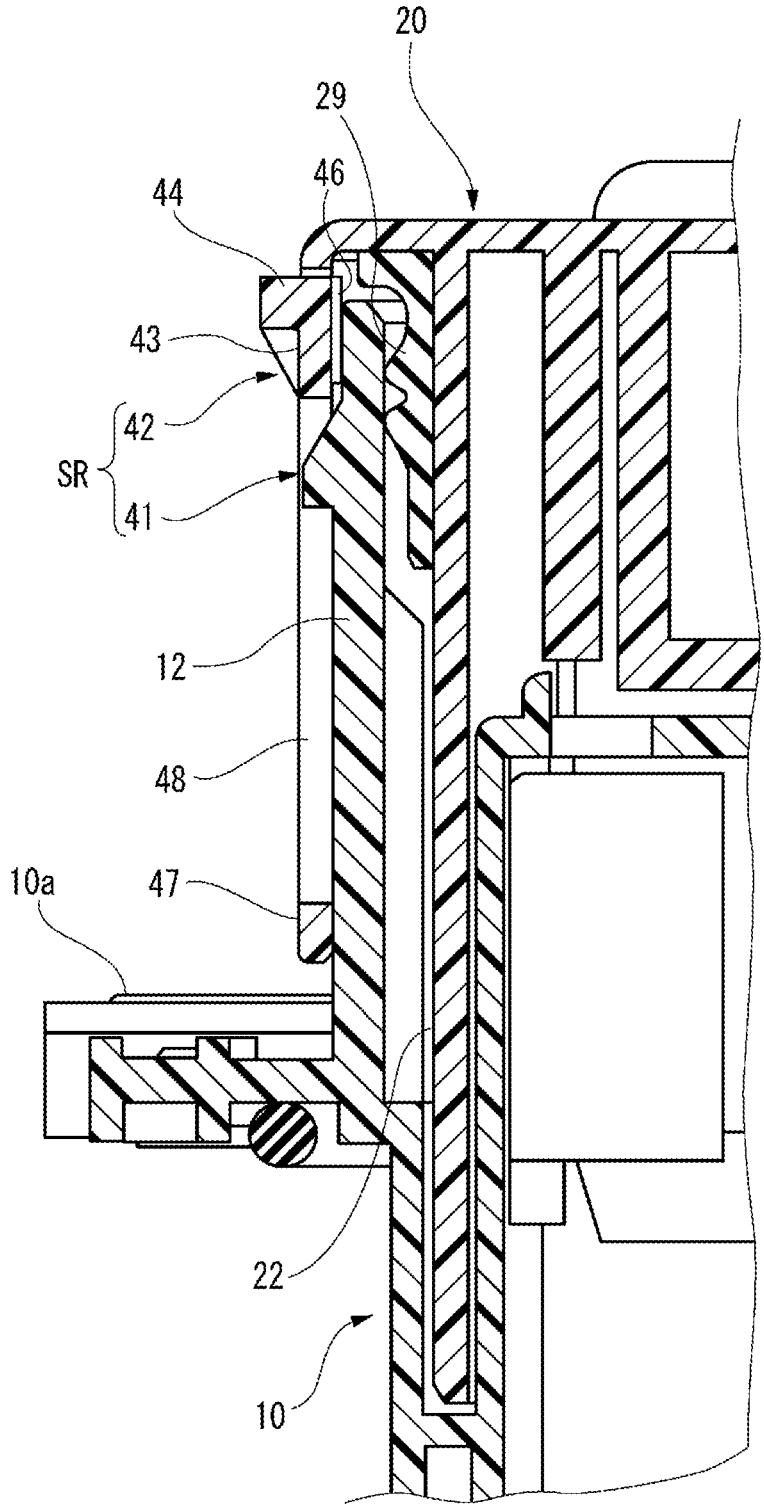
FIG. 8 is a cross-sectional view of a sub-lock unit when the first connector housing and the second connector housing are in the finally fitted state.

FIG. 7 is a perspective view of a part of the first connector housing and the second connector housing in cross section. FIG. 8 is a cross-sectional view of a sub-lock unit when the first connector housing and the second connector housing are in the finally fitted state.

As shown in FIGS. 7 and 8, the power supply circuit breaking device 1 is provided with a sub-lock unit SR on the other end. The sub-lock unit SR is configured by a sub-lock claw 41 provided to protrude to an outer surface of the first connector housing 10, and an operation portion 42 provided on the second connector housing 20.

Figure 9:
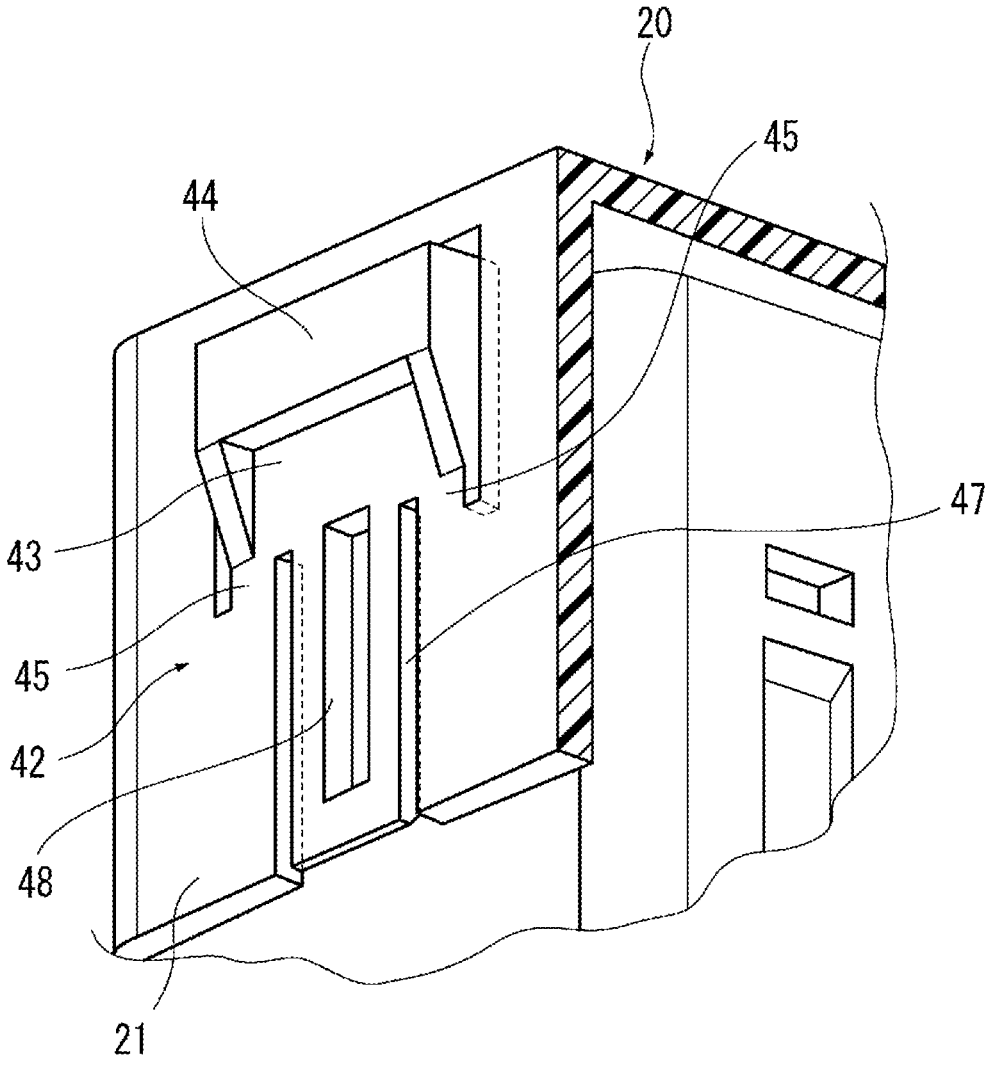
FIG. 9 is a perspective view of an operation portion configuring the sub-lock unit provided in the second connector housing.
Figure 10:
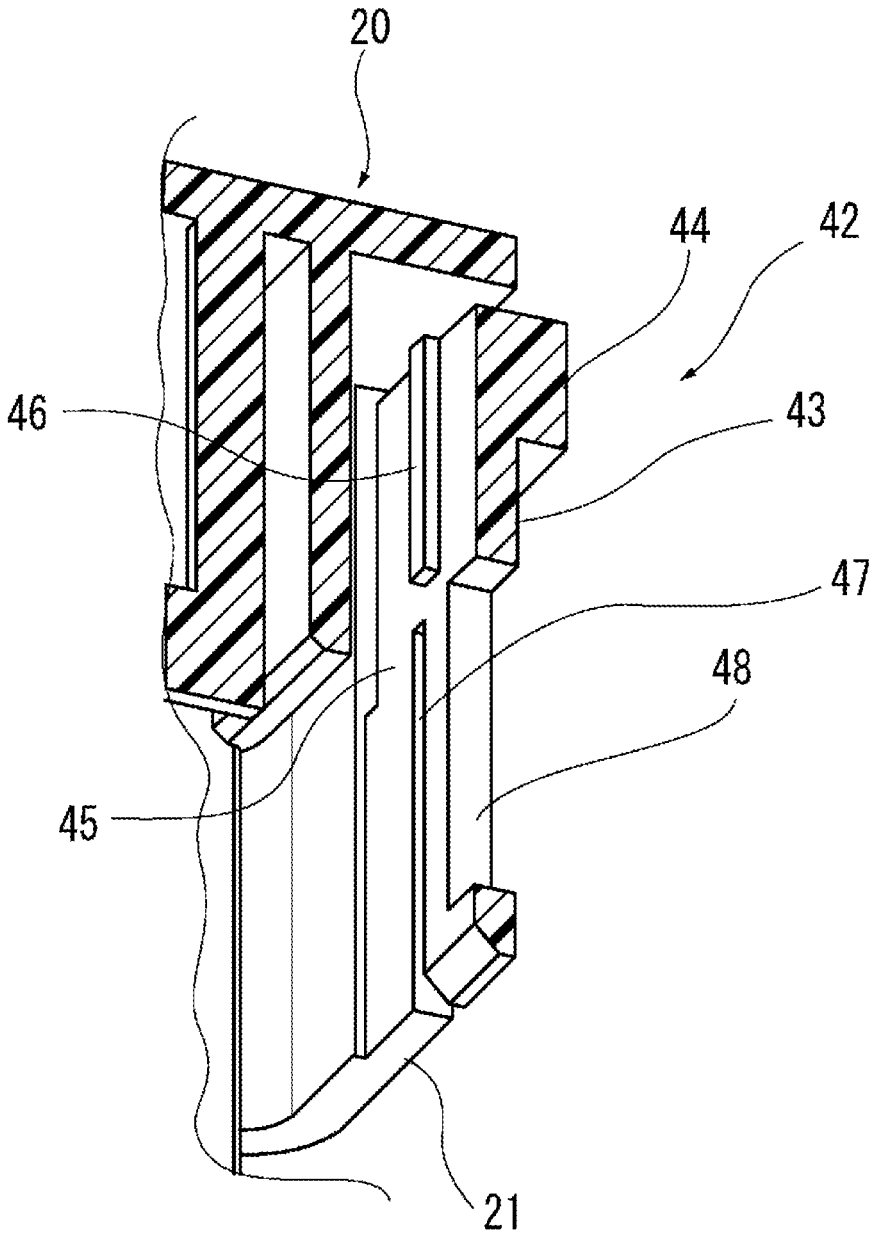
FIG. 10 is a perspective view of a part of the operation portion in the second connector housing as viewed from an inner side in cross section.

FIG. 9 is a perspective view of the operation portion configuring the sub-lock unit provided in the second connector housing. FIG. 10 is a perspective view of a part of the operation portion in the second connector housing as viewed from an inner side in cross section.

As shown in FIG. 9, the operation portion 42 is integrally formed on the outer peripheral tubular portion 21 of the second connector housing 20. The operation portion 42 is provided along an insertion-removal direction of the second connector housing 20 with respect to the first connector housing 10. The operation portion 42 has a pressing portion 43 on an upper side which is a removal direction side of the second connector housing 20 with respect to the first connector housing 10, and the pressing portion 43 has a pressing convex portion 44 that protrudes outward from an outer surface of the outer peripheral tubular portion 21. Connection portions 45 are provided at both ends of the pressing portion 43 on a lower side which is an insertion direction side of the second connector housing 20 with respect to the first connector housing 10. The pressing portion 43 is integrally connected to the outer peripheral tubular portion 21 of the second connector housing 20 by the connection portion 45.

An engaging plate portion 47 is integrally provided on the lower side of the pressing portion 43. The engaging plate portion 47 is formed in a long plate shape along the insertion-removal direction of the second connector housing 20 with respect to the first connector housing 10. In the engaging plate portion 47, an engaging hole 48 which is an elongated hole along the insertion-removal direction is formed at the center in a width direction. The sub-lock claw 41 can engage with the engaging hole 48. When the second connector housing 20 fitted to the first connector housing 10 is pulled out, the sub-lock claw 41 relatively moves in the engaging hole 48 formed in the engaging plate portion 47 and then engages with a lower edge of the locking hole 48. Accordingly, the second connector housing 20 is locked with respect to the first connector housing 10. Further, in the power supply circuit breaking device 1, a state where a part of the second connector housing 20 is fitted to the first connector housing 10 and locked by the sub-lock unit SR is referred to as a temporarily fitted state.

In the operation portion 42, by pressing the pressing convex portion 44 of the pressing portion 43, the connection portion 45 is elastically deformed, and the pressing portion 43 is displaced to the inside of the outer peripheral tubular portion 21. Then, the engaging plate portion 47 of the operation portion 42 is swung and inclined with the connection portion 45 as a fulcrum along with the displacement of the pressing portion 43, and a lower end portion thereof is displaced to the outside of the outer peripheral tubular portion 21. As a result, the sub-lock claw 41 is disengaged from the engaging hole 48 of the engaging plate portion 47, and the lock of the second connector housing 20 with respect to the first connector housing 10 is released.

As shown in FIG. 10, on an inner surface of the pressing portion 43, a pair of displacement restricting ribs 46 protruding inward is formed along the insertion-removal direction of the second connector housing 20. The displacement restricting ribs 46 of the pressing portion 43 are configured to abut against an outer peripheral surface at the upper end of the accommodation tubular portion 12 when the pressing convex portion 44 of the pressing portion 43 is carelessly pressed in the finally fitted state, so that the displacement of the pressing portion 43 to the inside of the outer peripheral tubular portion 21 is restricted, and the elastic deformation of the connection portion 45 is prevented. Therefore, the stagnation of the connection part 45 due to the pressing portion 43 being carelessly pressed is prevented.

In the power supply circuit breaking device 1 configured as described above, the main switch unit MSw is switched on in the finally fitted state (state shown in FIG. 6 and FIG. 7) locked by the main lock unit MR as well as in the temporarily fitted state (state shown in FIG. 4 and FIG. 5) locked by the sub-lock unit SR; the sub-switch unit SSw is switched on in the finally fitted state (state shown in FIG. 6 and FIG. 7) locked by the main lock unit MR, and is switched off in the temporarily fitted state (state shown in FIG. 4 and FIG. 5) locked by the sub-lock unit SR.

Next, in the power supply circuit breaking device 1 including the main lock unit MR and the sub-lock unit SR, cases where the second connector housing 20 is fitted to and separated from the first connector housing 10 will be described.

(Fitting Case)

In order to fit the second connector housing 20 to the first connector housing 10, the second connector housing 20 in which the lever 30 is disposed at the first operation position is brought close to the first connector housing 10. Further, the fitting tubular portion 22 of the second connector housing 20 is fitted into the accommodation tubular portion 12 of the first connector housing 10.

When the fitting tubular portion 22 of the second connector housing 20 is fitted into the accommodation tubular portion 12 of the first connector housing 10, the cam pin 11 is inserted into the cam groove 35 of the lever 30 from the insertion portion 35*a*. Further, in the sub-lock unit SR, the sub-lock claw 41 of the first connector housing 10 enter into the engaging hole 48 formed in the engaging plate portion 47 of the operation portion 42 of the second connector housing 20. Accordingly, the second connector housing 20 is temporarily fitted to the first connector housing 10 (see FIG. 4 and FIG. 5).

In the temporarily fitted state, the lever 30 at the first operation position is rotated to the second operation position. Then, the cam pin 11 moves along the curved portion 35*b* and the bent portion 35*c*, and the fitting force is applied between the first connector housing 10 and the second connector housing 20, so that the second connector housing 20 is pulled into the first connector housing 10 and brought into the finally fitted state (see FIG. 6 and FIG. 7). In the finally fitted state, the fitting tubular portion 22 of the second connector housing 20 is completely fitted to the accommodation tubular portion 12 of the first connector housing 10, and the accommodation tubular portion 12 enters between the fitting tubular portion 22 and the outer peripheral tubular portion 21. Further, the inner peripheral surface of an upper end of the accommodation tubular portion 12 is in close contact with the packing 29, and the space between the accommodation tubular portion 12 and the fitting tubular portion 22 is waterproof.

In the finally fitted state, the male terminal portion 25 of the main bus bar 24 is connected to the female terminal portion 14 of the main terminal 13. That is, the main switch unit MSw is switched on, and the power supply lines 2 connected to the main terminals 13 are electrically connected to each other via the main bus bar 24. Further, the male terminal portion 27 of the sub-bus bar 26 is connected to the sub terminal 16. That is, the sub-switch unit SSw is switched on, and the signal lines 3 connected to the sub terminals 16 are electrically connected to each other via the sub-bus bar 26.

Further, in the finally fitted state, the main lock claw 28 formed on the outer peripheral tubular portion 21 of the second connector housing 20 is engaged with the main lock hole 36 of the lever 30 in the main lock unit MR. Accordingly, the lever 30 is locked in the second operation position, and the rotation of the lever 30 is restricted. As described above, in the finally fitted state, the rotation of the lever 30 in the main lock unit MR is restricted, so that the first connector housing 10 and the second connector housing 20 are locked in the completely fitted state and maintained in the finally fitted state. In the finally fitted state, as shown in FIG. 9, the accommodation tubular portion 12 of the first connector housing 10 is disposed on a back side of the engaging plate portion 47 in the sub-lock unit SR. Therefore, in the finally fitted state, even if the pressing convex portion 44 of the operation portion 42 of the sub-lock unit SR is pressed, the engaging plate portion 47 is not inclined, and the lock in the sub-lock unit SR is prohibited from being released.

(Separating Case)

In order to separate the second connector housing 20 from the first connector housing 10, the lever 30 disposed at the second operation position is grasped and pulled up. Then, the main lock claw 28 of the second connector housing 20 is disengaged from the main lock hole 36 of the lever 30, the lock of the lever 30 is released by the main lock unit MR configured to maintain the finally fitted state, and the lever 30 becomes rotatable.

The rotatable lever 30 is rotated toward the first operation position. Then, accompanying with the rotation of the lever 30, the cam pin 11 moves along the bent portion 35*c* and the curved portion 35*b*, and the separation force is applied between the first connector housing 10 and the second connector housing 20, so that the second connector housing 20 in the finally fitted state with the first connector housing 10 is displaced toward the separating direction from the first connector housing 10 and brought into the temporarily fitted state (see FIG. 4 and FIG. 5).

In the temporarily fitted state, first, the male terminal portion 27 of the sub-bus bar 26 is pulled out from the sub terminal 16. That is, the sub-switch unit SSw is switched off, and the electrical connection between the signal lines 3 is released.

Figure 11:
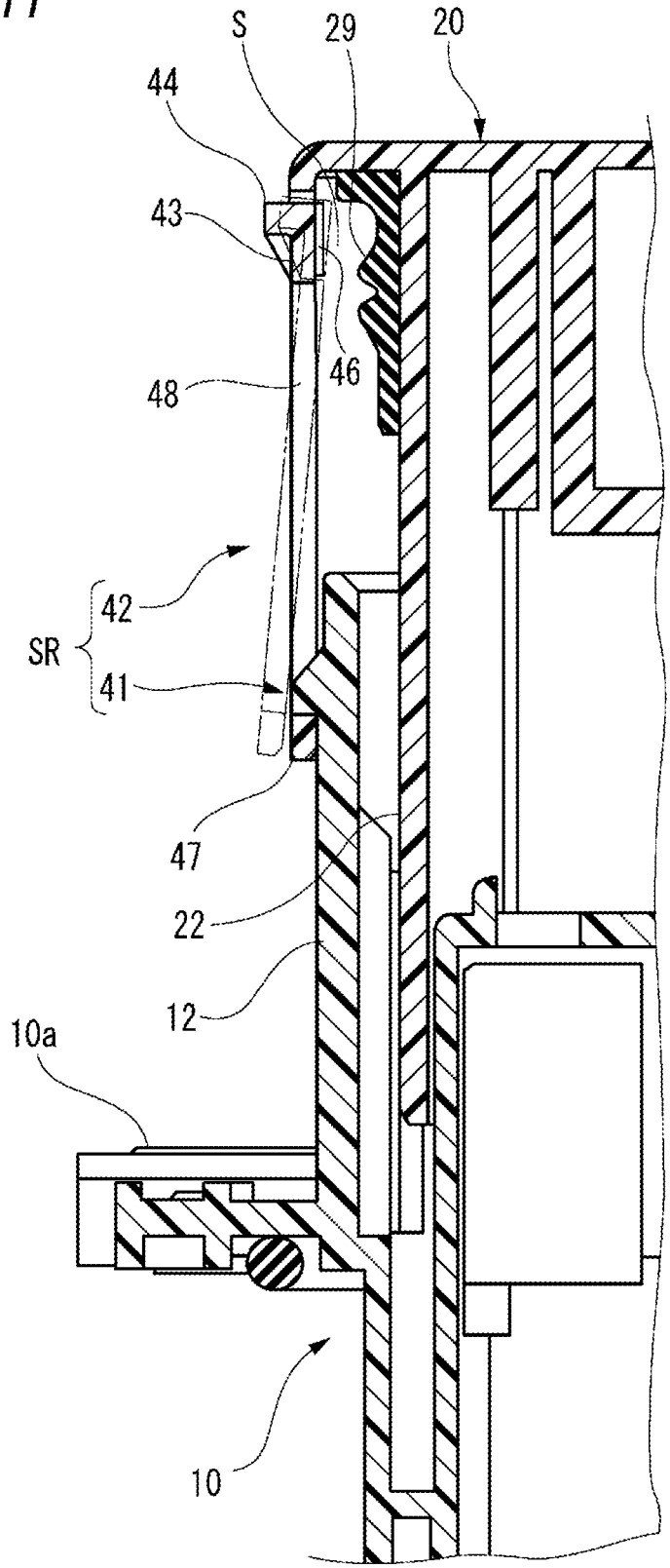
FIG. 11 is a cross-sectional view of the sub-lock unit when the first connector housing and the second connector housing are in the temporarily fitted state.

Further, in the temporarily fitted state, the operation portion 42 moves relative to the sub-lock claw 41 in the sub-lock unit SR. Accordingly, as shown in FIG. 11, the sub-lock claw 41 moves in the engaging hole 48 of the engaging plate portion 47 so as to engage and lock at the lower edge of the locking hole 48. Therefore, the second connector housing 20 is locked to the first connector housing 10 and maintained in the temporarily fitted state. In the temporarily fitted state, the male terminal portion 25 of the main bus bar 24 is maintained in the state of being connected to the female terminal portion 14 of the main terminal 13. That is, the main switch unit MSw is kept to be switched on, and the electrical connection between the power supply lines 2 is maintained.

From the temporarily fitted state, the pressing convex portion 44 formed on the pressing portion 43 of the operation portion 42 of the sub-lock unit SR is pressed. In the temporarily fitted state, as shown in FIG. 11, the accommodation tubular portion 12 of the first connector housing 10 on the back side of the engaging plate portion 47 is disposed at a position deviated downward. Therefore, in the temporarily fitted state, a space S is formed on the back side of the pressing portion 43 of the operation portion 42, so that the pressing portion 43 can be pressed. In the temporarily fitted state, when the pressing convex portion 44 of the pressing portion 43 is pressed, the connection portion 45 is elastically deformed and the pressing portion 43 is displaced to the inside of the outer peripheral tubular portion 21 in the operation portion 42 (see the two-dot chain line in FIG. 11). Then, the engaging plate portion 47 of the operation portion 42 is swung and inclined with a connection point with the outer peripheral cylindrical portion 21 as a fulcrum due to the connection portion 45, and a lower end portion thereof is displaced to the outside of the outer peripheral tubular portion 21. The sub-lock claw 41 disposed in the engaging hole 48 and engaging with the lower edge of the engaging hole 48 comes out from the engaging hole 48, and the lock of the lower edge of the engaging plate portion 47 by the sub-lock claw 41 is released. Therefore, the lock of the second connector housing 20 with respect to the first connector housing 10 by the sub-lock unit SR is released.

When the engaging plate portion 47 is swung to release the lock by the sub-lock unit SR in the temporarily fitted state, the pressing portion 43 comes into contact with the packing 29 on the back side, so that a swing range of the engaging plate portion 47 is restricted. Therefore, the operation portion 42 is prevented from being damaged due to the engaging plate portion 47 being swung more than necessary. That is, the packing 29 functions as a swing range restricting unit configured to restrict the swing range of the engaging plate portion 47 so as to prevent damage to the operation portion 42.

Once the lock by the sub-lock unit SR is released, the second connector housing 20 is separated from the first connector housing 10. Then, the fitting tubular portion 22 of the second connector housing 20 is pulled out from the accommodation tubular portion 12 of the first connector housing 10, and the male terminal portions 25 of the main bus bar 24 are pulled out from the female terminal portions 14 of the main terminal 13. Accordingly, the main switch units MSw are switched off, and the electrical connection between the power supply lines 2 is released.

As described above, in the power supply circuit breaking device 1 according to the present embodiment, the main switch unit MSw is switched on in the finally fitted state locked by the main lock unit MR as well as in the temporarily fitted state locked by the sub-lock unit SR; the sub-switch unit SSw is switched on in the finally fitted state locked by the main lock unit MR, and is switched off in the temporarily fitted state. Therefore, in the power supply circuit breaking device 1, after the sub-switch unit SSw is switched off and the electrical connection between the signal lines 3 is released, if the lock by the sub-lock unit SR is not released, the main switch unit MSw is switched off, and the electrical connection between the power supply lines 2 cannot be released. Accordingly, the occurrence of arcs, sparks or the like resulting from remaining current generated by releasing the connection between the power supply lines 2 immediately after releasing the connection between the signal lines 3 is prevented.

In addition, the sub-lock unit SR configured to lock the second connector housing 20 in the temporarily fitted state includes the sub-lock claw 41 formed on the first connector housing 10, and the operation portion 42 provided on the second connector housing 20 and having the engaging plate portion 47 engaging with the sub-lock claw 41 in the temporarily fitted state. Therefore, an increase in size can be prevented by providing the function of the sub-lock unit SR in the lever 30 configured to apply fitting force and separation force to the first connector housing 10 and the second connector housing 20.

That is, the occurrence of sparks, arcs or the like at the time of operation can be prevented, and miniaturization can be achieved.

Further, the engaging plate portion 47 of the sub-lock unit SR whose lock with the sub-lock claw 41 can be released by being swung is restricted from swinging by the first connector housing 10 disposed on the back side in the finally fitted state, and the space S is formed on the back side in the temporarily fitted state so that swing can be performed. That is, the lock release by operating the operation portion 42 of the sub-lock unit SR can be enabled in the temporarily fitted state, and can be prohibited in the finally fitted state. Accordingly, it is possible to prevent the lock release operation which is an erroneous operation in the sub-lock unit SR.

When the engaging plate portion 47 is swung to release the lock by the sub-lock unit SR in the temporarily fitted state, the swing range of the engaging plate portion 47 is restricted by bringing the engaging plate portion 47 into contact with the packing 29 which functions as the swing range restricting unit, so that the damage to the operation portion 42 due to the engaging plate portion 47 being swung more than necessary can be prevented.

According to the power supply circuit breaking device 1, by rotating the lever 30, the fitting and separating of the second connector housing 20 with respect to the first connector housing 10 can be easily performed with small operation force. As described above, even in the structure providing with the lever 30, the sub-lock unit SR configured to lock the second connector housing 20 to the first connector housing 10 in the temporarily fitted state is provided in the first connector housing 10 and the second connector housing 20, so that compared with a case where the sub-lock unit SR is provided on the lever 30, the increase in the size of the device due to an increase in the size of the lever 30 can be prevented.

Further, the sub-lock unit SR is provided on a side opposite to a rotation side of the lever 30, so that the operation of the sub-lock unit SR is not disturbed by the lever 30. Accordingly, after the second connector housing 20 is temporarily fitted to the first connector housing 10 by the operation of the lever 30, the sub-lock unit SR can be operated smoothly so as to release the second connector housing 20.

The invention is not limited to the above embodiment, and may be appropriately modified, improved or the like. In addition, materials, shapes, sizes, numerals, arrangement locations or the like of constituent elements in the above embodiment are optional as long as the object of the present invention can be achieved, and the present invention is not limited thereto.

For example, in the above embodiment, the lever 30 configured to apply the fitting force and the separation force between the second connector housing 20 and the first connector housing 10 by being rotated is provided, but the lever 30 may not necessarily be provided. When the lever 30 is not provided, the main lock unit MR is provided between the first connector housing 10 and the second connector housing 20.

In the above embodiment, the case where the packing 29 functions as the swing range restricting unit that restricts the swing range of the engaging plate portion 47 is illustrated, but the swing range restricting unit is not limited to the packing 29. For example, the edge portion of the accommodation tubular portion 12 of the first connector housing 10 may function as the swing range restricting unit, and the swinging engaging plate portion 47 comes into contact with the edge portion of the accommodation tubular portion 12 so that a swing range thereof is restricted.

When the engaging plate portion 47 is swung to release the lock by the sub-lock unit SR in the temporarily fitted state, the swing range is restricted by bringing the engaging plate portion 47 into contact with the packing 29 which functions as the swing range restricting unit, so that the damage to the operation portion 42 due to the engaging plate portion 47 being swung more than necessary can be prevented.

Here, characteristics of the embodiment of the power supply circuit breaking device according to the present invention described above are summarized briefly in the following [1] to [5], respectively.

[1] A power supply circuit breaking device including:

a first connector housing (10);

a second connector housing (20) that is configured to be fitted to and separated from the first connector housing (10);

a main lock unit (MR) that is configured to lock in a finally fitted state in which the second connector housing (20) is completely fitted to the first connector housing (10);

a sub-lock unit (SR) that is configured to lock in a temporarily fitted state in which the second connector housing (20) is displaced toward a separating direction from the finally fitted state and a part thereof is fitted to the first connector housing (10);

a main switch unit (MSw) that is configured to be switched on in the finally fitted state and the temporarily fitted state; and a sub-switch unit (SSw) that is configured to be switched on in the finally fitted state and switched off in the temporarily fitted state, wherein the sub-lock unit (SR) includes:

a claw portion (sub-lock claw 41) formed in the first connector housing (10); and an operation portion (42) provided in the second connector housing (20) and having an engaging plate portion (47) engaged with the claw portion (sub-lock claw 41) in the temporarily fitted state.

[2] The power supply circuit breaking device according to [1], wherein the engaging plate portion (47) is provided swingably with respect to the second connector housing (20), in the finally fitted state, the first connector housing (10) is disposed on a back side of the engaging plate portion so as to restrict a swinging of the engaging plate portion, in the temporarily fitted state, a space is formed on the back side of the engaging plate portion so as to swing the engaging plate portion, and an engagement state in which the engaging plate portion is engaged with the claw portion (sub-lock claw 41) is released by swinging the engaging plate portion (47) in the temporarily fitted state.

[3] The power supply circuit breaking device according to [2], wherein the second connector housing (20) includes a swing range restricting unit (packing 29) that is configured to restrict a swing range of the engaging plate portion (47) of the sub-lock unit (SR).

[4] The power supply circuit breaking device according to any one of [1] to [3], wherein the second connector housing (20) includes a lever (30) rotatably supported, and wherein fitting force and separation force are applied to the first connector housing (10) by rotation of the lever (30).

[5] The power supply circuit breaking device according to [4], wherein the lever (30) supported by the second connector housing (20) is rotated at one end of the second connector housing (20), and wherein the sub-lock unit (SR) is provided at the other end of the second connector housing (20).

What is claimed is:

1. A power supply circuit breaking device comprising:

a first connector housing;

a second connector housing that is configured to be fitted to and separated from the first connector housing;

a main lock unit that is configured to lock in a finally fitted state in which the second connector housing is completely fitted to the first connector housing;

a sub-lock unit that is configured to lock in a temporarily fitted state in which the second connector housing is displaced toward a separating direction from the finally fitted state and a part thereof is fitted to the first connector housing;

a main switch unit that is configured to be switched on in the finally fitted state and the temporarily fitted state; and a sub-switch unit that is configured to be switched on in the finally fitted state and switched off in the temporarily fitted state, wherein the sub-lock unit includes:

a claw portion formed in the first connector housing; and an operation portion provided in the second connector housing and having an engaging plate portion engaged with the claw portion in the temporarily fitted state.

2. The power supply circuit breaking device according to claim 1, wherein the engaging plate portion is provided swingably with respect to the second connector housing, in the finally fitted state, the first connector housing is disposed on a back side of the engaging plate portion so as to restrict a swinging of the engaging plate portion, in the temporarily fitted state, a space is formed on the back side of the engaging plate portion so as to swing the engaging plate portion, and an engagement state in which the engaging plate portion is engaged with the claw portion is released by swinging the engaging plate portion in the temporarily fitted state.

3. The power supply circuit breaking device according to claim 2, wherein the second connector housing includes a swing range restricting unit that is configured to restrict a swing range of the engaging plate portion of the sub-lock unit.

4. The power supply circuit breaking device according to claim 1, wherein the second connector housing includes a lever rotatably supported, and wherein fitting force and separation force are applied to the first connector housing by rotation of the lever.

5. The power supply circuit breaking device according to claim 4, wherein the lever supported by the second connector housing is rotated at one end of the second connector housing, and wherein the sub-lock unit is provided at another end of the second connector housing.

* * * * *